US005441188A

United States Patent [19]

Rosenstein

[11] Patent Number: 5,441,188

[45] Date of Patent: Aug. 15, 1995

[54] SHOULDER STRAP AND JEWELRY RETAINER

[76] Inventor: Julia A. Rosenstein, 795 Granada Dr., Greenwood, Ind. 46143

[21] Appl. No.: 53,692

[22] Filed: Apr. 29, 1993

[51] Int. Cl.[6] ..... A41F 15/02

[52] U.S. Cl. ..... 224/264; 63/1.1; 24/13; 24/351

[58] Field of Search ..... 224/264; 2/268; 63/1.1, 63/2; 40/1.5, 1.6; 24/12, 13, 351, 314, 518

[56] References Cited

U.S. PATENT DOCUMENTS

| | | | |
|---|---|---|---|
| 1,027,527 | 5/1912 | Davis | 224/264 |
| 2,113,786 | 4/1938 | Garfinkel | 63/1.1 |
| 4,040,147 | 8/1977 | King | 224/264 |
| 4,386,723 | 6/1983 | Mule | 224/264 |
| 4,879,768 | 11/1989 | McClees et al. | 224/264 |
| 4,887,318 | 12/1989 | Weinreb | 224/264 |
| 5,016,368 | 5/1991 | Cassata | 40/1.5 |

*Primary Examiner*—Linda J. Sholl

[57] ABSTRACT

A shoulder strap and jewelry retainer removeably attachable to a user's garment for support of ornamental jewelry attachments and for the retention of a shoulder strap so that a user may carry a sling or strap equipped article without lifting the shoulder while simultaneously preventing theft of the mentioned article. The shoulder strap and jewelry retainer may be attached to the user's garment by any conventional means and includes a releasable clip structure capable of capturing a shoulder strap. Ornamental jewelry is attached to the clip for disguising the clip structure and for accenting the user's clothing.

3 Claims, 4 Drawing Sheets

SHOULDER STRAP AND JEWELRY RETAINER

BACKGROUND OF THE INVENTION

1. Field of the Invention

The present invention relates to shoulder strap retainers and more particularly pertains to shoulder strap and jewelry retainers which may be used to retain jewelry upon the shoulder of a user and to allow the user to carry a strap equipped article without lifting the shoulder while further preventing theft of the mentioned article.

2. Description of the Prior Art

The use of shoulder strap retainers is known in the prior art. More specifically, shoulder strap retainers heretofore devised and utilized for the purpose of retaining shoulder slings are known to consist basically of familiar, expected and obvious structural configurations, notwithstanding the myriad of designs encompassed by the crowded prior art which have been developed for the fulfillment of countless objectives and requirements.

For example, U.S. Pat. No. 4,881,672 describes a safety attachment purse hook that allows the strap of a pocket book or purse to be retained to the shoulder of a jacket or coat.

Another similar device can be seen in U.S. Pat. No. 4,055,873 which illustrates the same basic idea of the foregoing patent but utilizes hook and loop fasteners to retain accessories such as skiing hats and skiing goggles.

U.S. Pat. No. 3,940,039 describes a shoulder sling retainer that may be attached to a user's clothing for retaining the sling of an article.

The shoulder strap retainers previously mentioned are all capable of retaining shoulder slings but only inasmuch as they are all readily visible to the eye and markedly attached to a user's clothing. In addition, the shoulder sling retainers mentioned heretofore do not allow for the disguise of the retainer and for the attachment of interchangeable jewelry to the retainer and as can be appreciated, readily visible shoulder strap retainers operate to the advantage of a potential thief.

In this respect, the shoulder sling and jewelry retainer according to the present invention substantially departs from the conventional concepts and designs of the prior art, and in so doing provides an apparatus primarily developed for the purpose of retaining jewelry upon the shoulder of the user and to allow a user to carry a sling equipped article without lifting the shoulder while further preventing theft of the mentioned article through the use of a concealed retainer structure.

Therefore, it can be appreciated that there exists a continuing need for new and improved shoulder sling retainers which can be utilized to retain jewelry upon the shoulder of the user and to allow a user to carry a sling equipped article without lifting the shoulder while further preventing theft of the mentioned article through the use of a concealed retainer structure. In this regard, the present invention substantially fulfills this need.

SUMMARY OF THE INVENTION

In view of the foregoing disadvantages inherent in the known types of shoulder strap retainers now present in the prior art, the present invention provides an improved shoulder strap and jewelry retainer construction wherein the same can be utilized to retain jewelry upon the shoulder of the user and allow a user to carry a sling equipped article without lifting the shoulder while further preventing theft of the mentioned article by concealingly attaching the strap to the user's garment. As such, the general purpose of the present invention, which will be described subsequently in greater detail, is to provide a new shoulder strap and jewelry retainer apparatus which has many of the advantages of the shoulder sling retainers mentioned heretofore and many novel features that result in a shoulder sling and jewelry retainer that is not anticipated, rendered obvious, suggested, or even implied by any of the prior art, either alone or in any combination thereof.

To attain this, the present invention essentially comprises a shoulder strap and jewelry retainer removeably attachable to a user's outer garment for support of ornamental jewelry attachments and for the retention of a shoulder strap associated with a purse or the like, whereby a user may carry the strap equipped article without lifting the shoulder while simultaneously preventing theft of the mentioned article through the provision of a concealed attachment to the garment. The shoulder strap and jewelry retainer may be attached to the user's garment by at least one pin, by hook and loop fasteners, by sewing, or by any other conventional means, while allowing the opening of a clip structure capable of capturing a shoulder strap within. Ornamental jewelry may be attached to the clip to provide for disguising the clip structure and accenting the user's clothing.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved shoulder strap and jewelry retainer that is not anticipated, rendered obvious, suggested, or even implied by any of the prior art, either alone or in any combination thereof.

It is another object of the present invention to provide a new shoulder strap and jewelry retainer which may be easily and efficiently manufactured and marketed.

It is a further object of the present invention to provide a new shoulder strap and jewelry retainer which is of a durable and reliable construction.

An even further object of the present invention is to provide a new shoulder strap and jewelry retainer which is susceptible of a low cost of manufacture with regard to both materials and labor, and which accordingly is then susceptible of low prices of sale to the consuming public, thereby making such shoulder strap and jewelry retainers economically available to the buying public.

Still yet another object of the present invention is to provide a new shoulder strap and jewelry retainer which provides in the apparatuses and methods of the prior art some of the advantages thereof, while simultaneously overcoming some of the disadvantages normally associated therewith.

Still another object of the present invention is to provide a new shoulder strap and jewelry retainer for the retention of a shoulder sling whereby a user may carry the sling equipped article without lifting the shoulder while simultaneously preventing theft of the mentioned article.

Yet another object of the present invention is to provide a new shoulder strap and jewelry retainer that may be attached to the User's garment by at least one pin while allowing the opening of a clip structure capable of capturing a shoulder strap therein.

Even still another object of the present invention is to provide a new shoulder strap and jewelry retainer that will allow ornamental jewelry to be attached to the clip for disguising the clip structure and for accenting the user's clothing.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
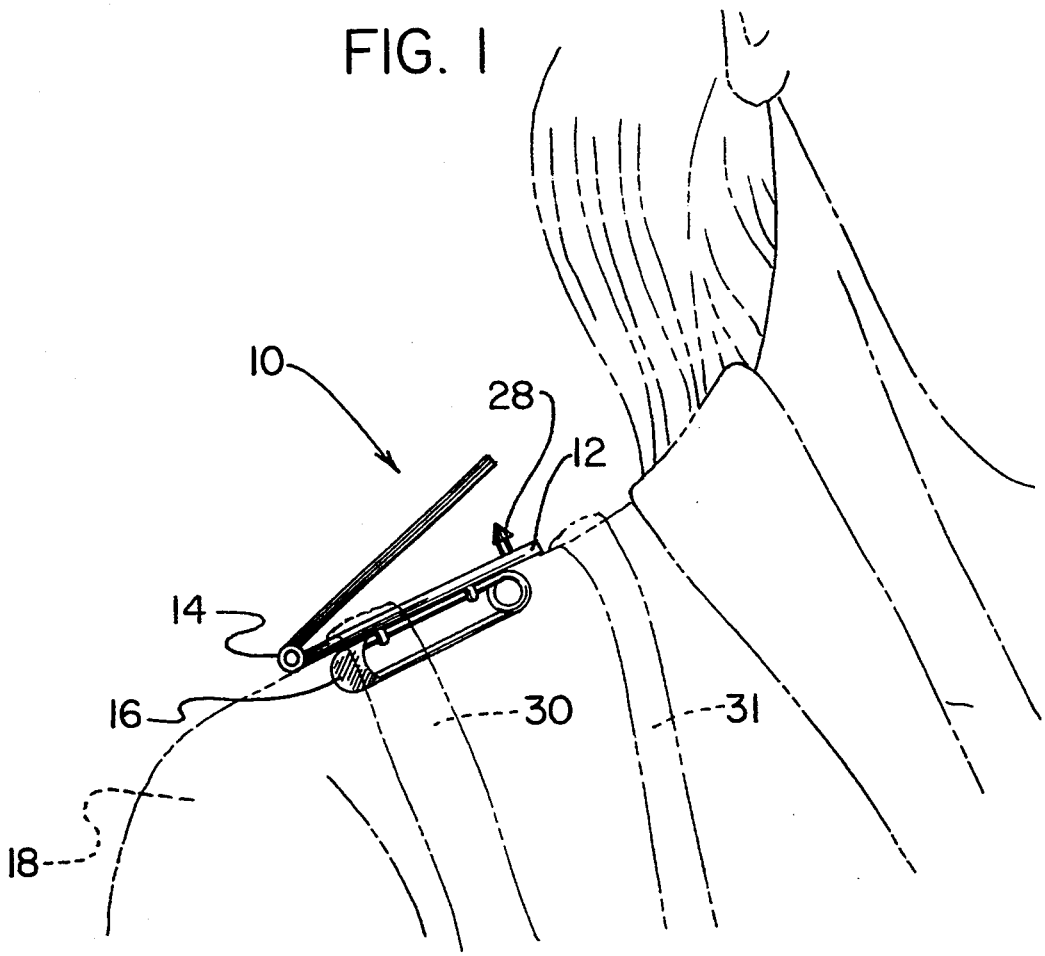
FIG. 1 is a front elevation view of a shoulder strap and jewelry retainer comprising the present invention.

With reference now to the drawings, and in particular to FIGS. 1–4 thereof, a new shoulder strap and jewelry retainer embodying the principles and concepts of the present invention and generally designated by the reference numeral 10 will be described.

Figure 2:
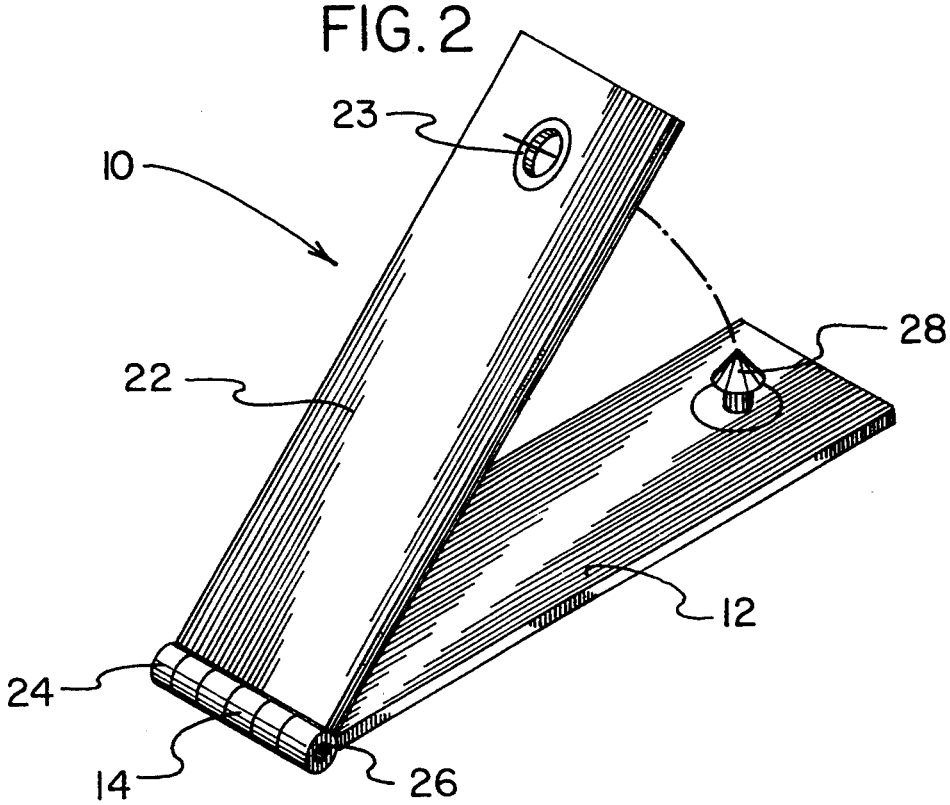
FIG. 2 is a perspective view of the present invention.
Figure 3:
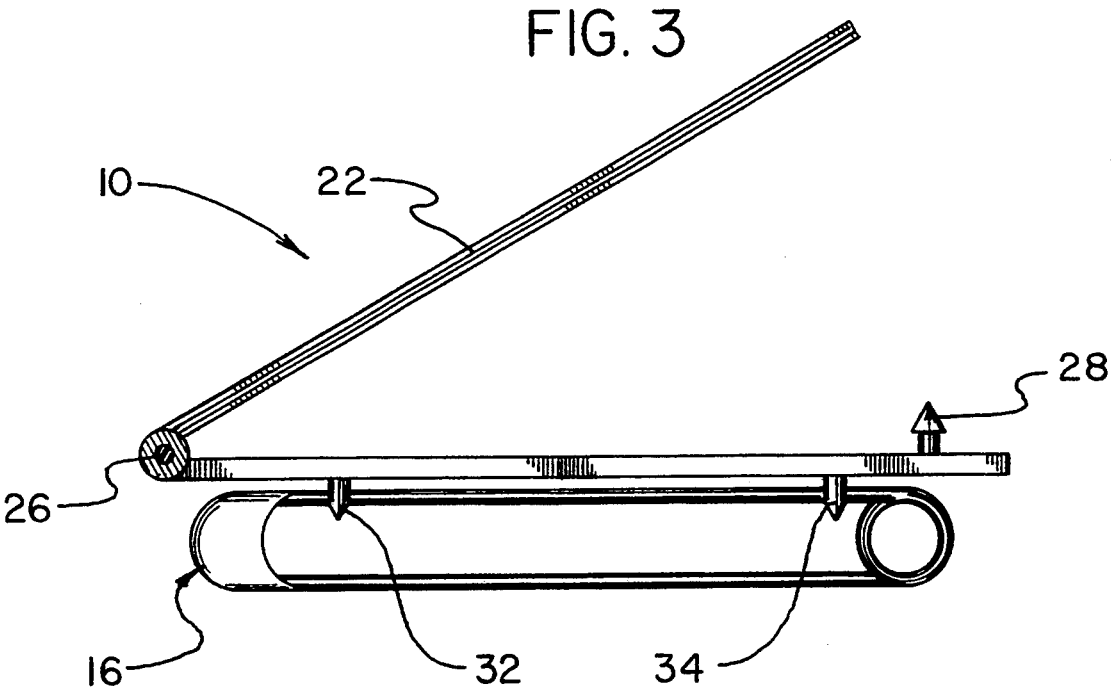
FIG. 3 is an enlarged front elevation view of the invention.

More specifically, it will be noted that the shoulder strap and jewelry retainer 10 comprises a substantially rectangular base plate 12 formed in such a manner as to define a first hinge portion 14. The base plate 12 is provided with a pair of securing pins 16, 17 which may be used to attach the invention 10 to the shoulder area of a user's clothing 18. The invention 10 further comprises a pivoting member 22 that is constructed from a material capable of resilient deformation which is formed in such a manner so as to define an aperture 23 proximate one end thereof. The pivoting member 22 is further formed in such a manner as to define a second hinge portion 24 at an opposed end that may be joined to said first hinge portion 14 of the base plate 12 by the use of a hinge pin 26 in a conventional manner. At the end opposite of the first hinge portion 14 of the base plate 12 is a fastener 28 that is removably frictionally engageable to the aperture 23 to facilitate a securing of the pivoting member 22 to the base plate 12 for capturing a shoulder strap 30 therebetween. As best illustrated in FIGS. 2 and 3 of the drawings, the fastener 28 comprises an unlabeled cylindrical boss which extends orthogonally upward from the base plate 12 proximate a second end thereof and terminates in an upper distal end. Further, an unlabeled conical projection having a pointed end and a circular base is fixedly secured at the circular base thereof to the upper distal end of the cylindrical boss. By this structure, the conical projection extends through the aperture 23 upon closing of the device 10 to retain the pivoting member 22 in a closed position relative to the base plate 12.

Figure 4:
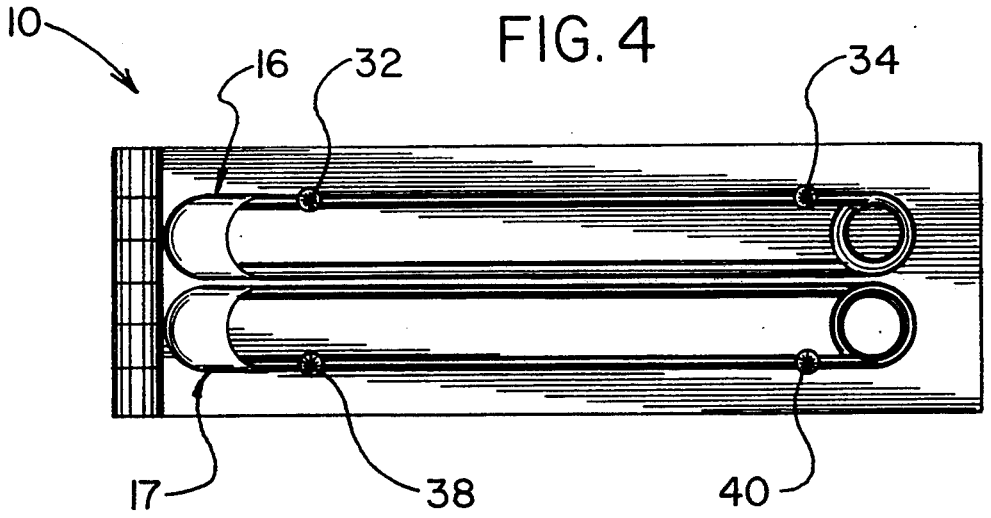
FIG. 4 is a bottom plan view of the invention showing the pins folded flat for storage.
Figure 5:
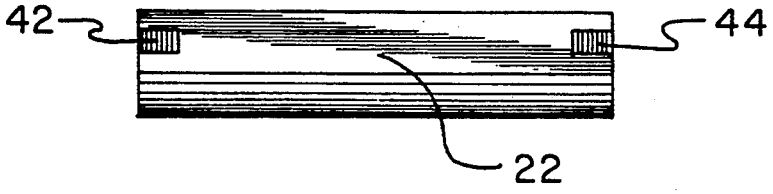
FIG. 5 is a partial end elevation view of the invention detailing a jewelry retention slot present thereon.
Figure 6:
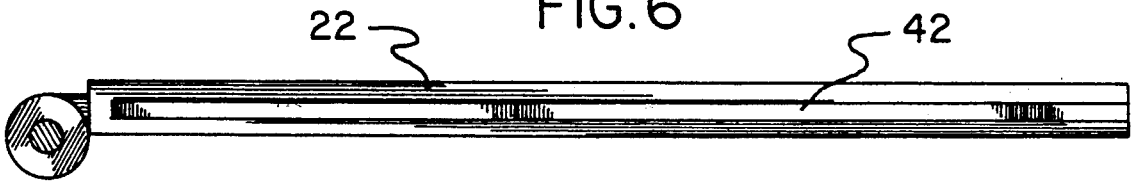
FIG. 6 is a partial front elevation view detailing the jewelry retention slot.
Figure 7:
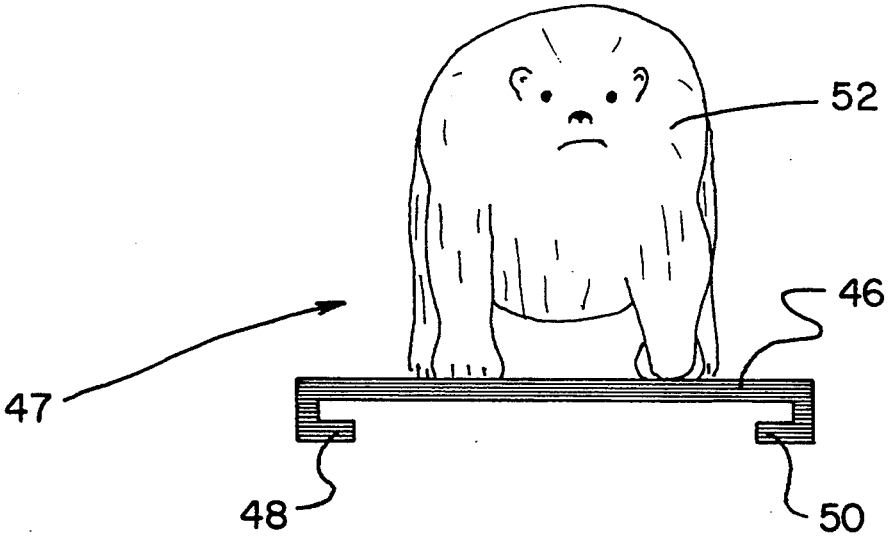
FIG. 7 is a partial end elevation view of the invention detailing a jewelry attachment.
Figure 8:
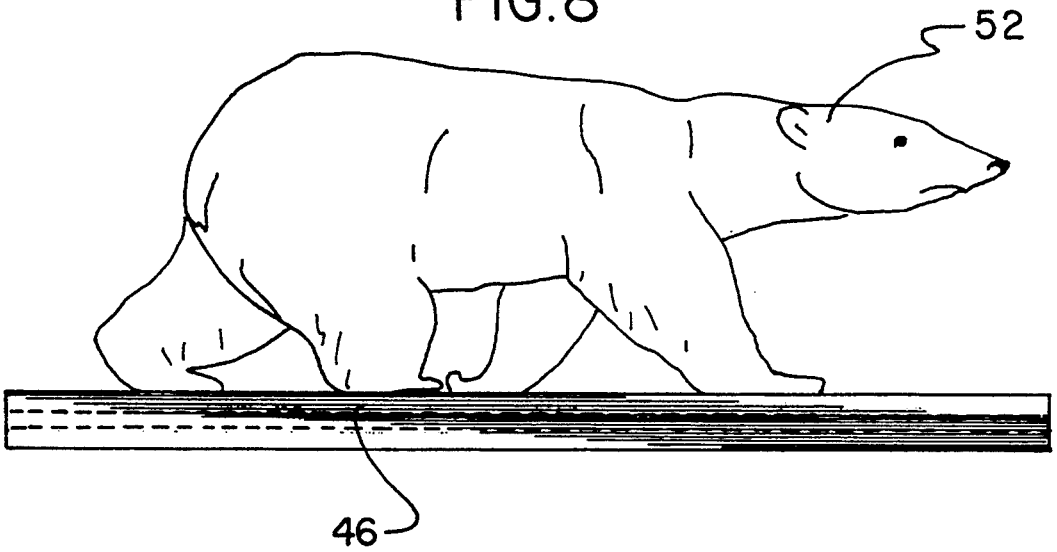
FIG. 8 is a partial front elevation view of detailing the jewelry attachment.

With further reference to FIGS. 1–4, it can be seen that the pin 16 is secured to the base plate 12 by pin holders 32, 34 and as best shown in FIG. 4, the invention 10 may be equipped with a plurality of such pins 16, 17, each of which may be connected to the base plate 12 with pin holders 32, 34 and 38, 40 respectively, thereby to increase the amount of support allocated to the invention. Each of the pin holders 32, 34, 38, 40 may be designed as a rigid post structure having a through-extending aperture orthogonally directed to the axis of the post, with the associated respective pin 16, 17 being rotatably secured within the aperture as illustrated.

Figure 10:
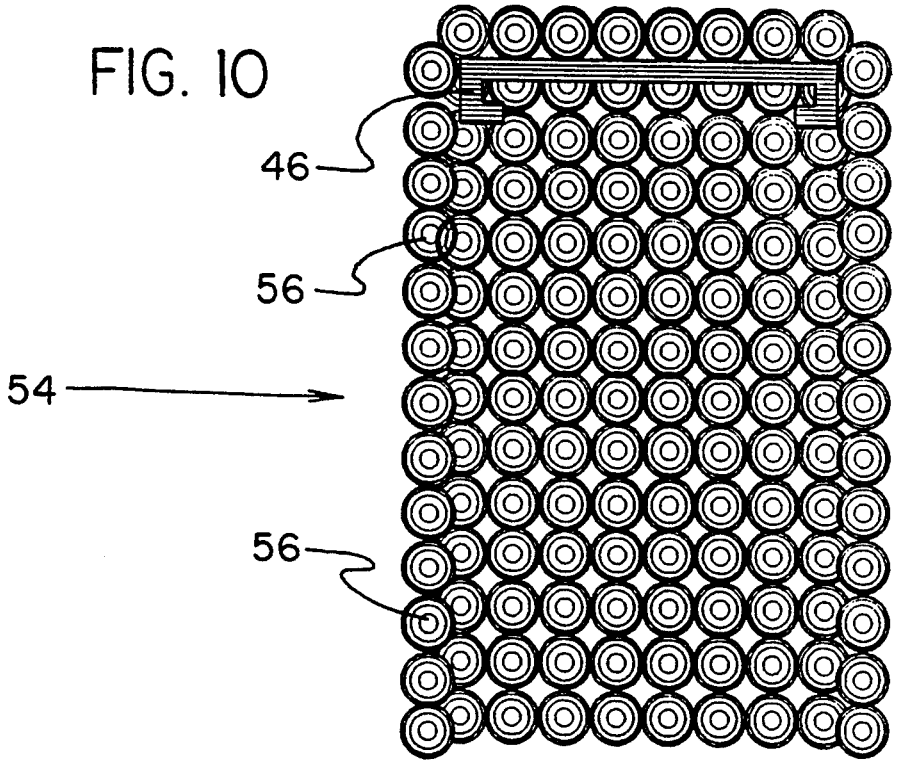
FIG. 10 is an end elevation view of the jewelry attachment pictured in FIG. 9.
Figure 9:
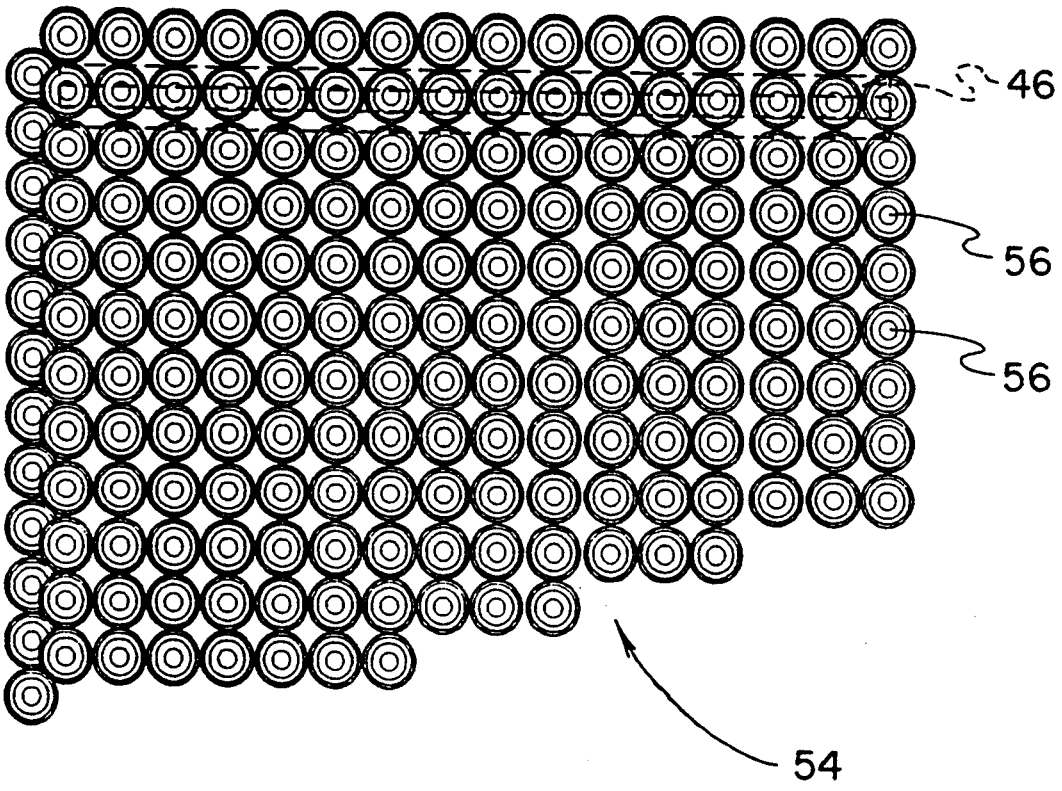
FIG. 9 is a front elevation view of a jewelry attachment comprising a plurality of beads attached to strings and arranged in a hanging manner.

In reference now to FIGS. 5–8, it can be seen that the pivoting member 22 further comprises a first jewelry retention channel 42 and a second jewelry retention channel 44 that are engageable with a jewelry base 46 which defines a substantially c-shaped member having a first side 48 and a second side 50. The sides 48, 50 may be slideably interlocked with the channels 42, 44, respectively. An ornament 52 is fixedly secured to the jewelry base 46. The jewelry base 46 is removably attached to the pivoting member 22 with the foregoing structure so as to facilitate the interchanging of differently styled ornament and jewelry base assemblies 47. A second example 54 of one of the many possible ornament configurations attachable to the invention 10 can be seen in FIGS. 9 and 10 and is comprised of a plurality of beads 56 attached to strings (not shown) that are arranged in a hanging manner over the jewelry base 46.

As to the manner of usage and operation of the present invention, the same should be apparent from the above description. Accordingly, no further discussion relating to the manner of usage and operation will be provided.

In summary, the invention 10 can be attached to the garment permanently by sewing it in place, or it can be affixed with a pin or hook and loop material to facilitate transfer to another garment. It is equally adaptable to both men's and women's clothing. Pieces designed for menswear would be masculine and could be made as plain gold or platinum colored tapered bars with a concave end; they would be very attractive as affixed to a blazer or sport jacket, and more subtle designs could be used for dress suits. Hence, the invention 10 is decorative, and anyone who has ever carried a bag or camera case with a shoulder strap will attest to the need for some sort of retention to obviate the contortions typically required to keep the strap from slipping off the shoulder. Finally, an as an added benefit, the invention 10 will afford the wearer added security since a would-be purse snatcher will be unpleasantly surprised upon the attempted quick escape and abandon the article rather than be apprehended.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A shoulder strap retainer comprising:

a base plate having first and second base plate ends, and a top surface and a bottom surface;

a pivoting member having first and second pivoting member ends and being hingedly coupled at said first pivoting member end to said first base plate end of said base plate, said pivoting member further having a through-extending aperture proximal to said second pivoting member end;

a fastener mounted to said top surface of said base plate proximal to said second base plate end thereof, said fastener comprising a cylindrical boss which extends orthogonally upward from said base plate and terminates in an upper distal end, and a conical projection having a pointed end and a circular base fixedly secured at said circular base thereof to said upper distal end of said cylindrical boss, such that said conical projection extends through said aperture in said pivoting member to retain said pivoting member against and coplanar with said base plate, thereby capturing a shoulder strap against said base plate between said base plate and said pivoting member and between said fastener and said first end of said base plate;

and, at least one pin pivotally coupled to said bottom surface of said base plate for securing said base plate to an article of clothing, and further comprising a pair of pin holders projecting from said bottom surface of said base plate for pivotally coupling said at least one pin to said base plate, each of said pin holders comprising a cylindrical post orthogonally mounted to said bottom surface of said base plate, said pin holders each having a post aperture extending orthogonally through said post relative to a longitudinal axis of said post, with said at least one pin projecting through said post apertures of said cylindrical posts of said pin holders.

2. A shoulder strap retainer comprising:

a base plate having first and second base plate ends, and a top surface and a bottom surface;

a pivoting member having first and second pivoting member ends and being hingedly coupled at said first pivoting member end to said first base plate end of said base plate, said pivoting member further having a through-extending aperture proximal to said second pivoting member end, said pivoting member comprising a substantially rectangular planar member having opposed first and second sides with a first jewelry retention channel extending along said first side thereof and a second jewelry retention channel extending along said second side thereof, said channels being coextensive and extending along substantially an entire longitudinal length of said pivoting member;

a fastener mounted to said top surface of said base plate proximal to said second base plate end thereof, said fastener comprising a cylindrical boss which extends orthogonally upward from said base plate and terminates in an upper distal end, and a conical projection having a pointed end and a circular base fixedly secured at said circular base thereof to said upper distal end of said cylindrical boss, such that said conical projection extends through said aperture in said pivoting member to retain said pivoting member against and coplanar with said base plate, thereby capturing a shoulder strap against said base plate between said base plate and said pivoting member and between said fastener and said first end of said base plate;

at least one pin pivotally coupled to said bottom surface of said base plate for securing said base plate to an article of clothing;

a pair of pin holders projecting from said bottom surface of said base plate for pivotally coupling said at least one pin to said base plate, each of said pin holders comprising a cylindrical post orthogonally mounted to said bottom surface of said base plate, said pin holders each having a post aperture extending orthogonally through said post relative to a longitudinal axis of said post, with said at least one pin projecting through said post apertures of said cylindrical posts of said pin holders;

a jewelry base slidably engaged to said pivoting member, said jewelry base comprising a substantially C-shaped member having first and second jewelry base sides, with said first jewelry base side projecting into said first jewelry retention channel, and said second jewelry base side projecting into said second jewelry retention channel;

and, an ornament coupled to said jewelry base.

3. A shoulder strap retainer comprising:

a base plate having first and second base plate ends, and a top surface and a bottom surface;

a pivoting member having first and second pivoting member ends and being hingedly coupled at said first pivoting member end to said first base plate end of said base plate, said pivoting member further having a through-extending aperture proximal to said second pivoting member end, said pivoting member comprising a substantially rectangular planar member having opposed first and second sides with a first jewelry retention channel extending along said first side thereof and a second jewelry retention channel extending along said second side thereof, said channels being coextensive and extending along substantially an entire longitudinal length of said pivoting member;

a fastener mounted to said top surface of said base plate proximal to said second base plate end thereof, said fastener comprising a cylindrical boss which extends orthogonally upward from said base plate and terminates in an upper distal end, and a conical projection having a pointed end and a circular base fixedly secured at said circular base thereof to said upper distal end of said cylindrical boss, such that said conical projection extends through said aperture in said pivoting member to retain said pivoting member against and coplanar with said base plate, thereby capturing a shoulder strap against said base plate between said base plate and said pivoting member and between said fastener and said first end of said base plate;

at least one pin pivotally coupled to said bottom surface of said base plate for securing said base plate to an article of clothing;

a pair of pin holders projecting from said bottom surface of said base plate for pivotally coupling said at least one pin to said base plate, each of said pin holders comprising a cylindrical post orthogonally mounted to said bottom surface of said base plate, said pin holders each having a post aperture extending orthogonally through said post relative to a longitudinal axis of said post, with said at least one pin projecting through said post apertures of said cylindrical posts of said pin holders;

a jewelry base slidably engaged to said pivoting member, said jewelry base comprising a substantially C-shaped member having first and second jewelry base sides, with said first jewelry base side projecting into said first jewelry retention channel, and said second jewelry base side projecting into said second jewelry retention channel;

and, an ornament coupled to said jewelry base, said ornament comprising a plurality of strings attached to said jewelry base so as to hang downwardly therefrom, and a plurality of beads being mounted along each of said strings, wherein said plurality of beads are operable to conceal said base plate, said pivoting member, said fastener, said at least one pin, said pin holders, and said jewelry base from view.

* * * * *